US006182648B1

(12) United States Patent
Lundgren

(10) Patent No.: US 6,182,648 B1
(45) Date of Patent: Feb. 6, 2001

(54) TENNIS BALL THROWING DEVICE

(76) Inventor: Charles G. Lundgren, 4539 Winners Cir., Apt. 1611, Sarasota, FL (US) 34238-5502

( * ) Notice: Under 35 U.S.C. 154(b), the term of this patent shall be extended for 0 days.

(21) Appl. No.: 09/599,335

(22) Filed: Jun. 22, 2000

(51) Int. Cl.[7] ..... F41B 3/03
(52) U.S. Cl. ..... 124/7; 124/17
(58) Field of Search ..... 124/4, 7, 16, 17

(56) References Cited

U.S. PATENT DOCUMENTS

| | | | | |
|---|---|---|---|---|
| 1,777,976 | | 10/1930 | Lacoste . | |
| 2,080,958 | * | 5/1937 | Beasley et al. | 124/7 |
| 3,777,733 | * | 12/1973 | Mitchell | 124/7 |
| 3,779,227 | | 12/1973 | Scott | 124/16 |
| 3,802,409 | | 4/1974 | Mike et al. . | |
| 4,111,179 | * | 9/1978 | Hashimoto | 124/7 |
| 4,261,319 | | 4/1981 | Dixon | 124/21 |
| 5,123,643 | | 6/1992 | Heilhecker et al. . | |
| 5,383,657 | | 1/1995 | Rathmell . | |
| 5,975,527 | | 11/1999 | Winchester . | |

FOREIGN PATENT DOCUMENTS

| | | | | |
|---|---|---|---|---|
| 816821 | * | 1/1951 | (DE) | 124/7 |
| 494211 | * | 9/1919 | (FR) | 124/7 |

* cited by examiner

*Primary Examiner*—John A. Ricci
(74) *Attorney, Agent, or Firm*—Charles J. Prescott

(57) ABSTRACT

A portable tennis net post-supported tennis ball-throwing device including an elongated support member with a U-shaped clamp for attaching the support member in an upright orientation to an upright tennis net support post. An elongated rigid throwing rod is pivotally connected at one end portion thereof to the support member by a pivotal connection therebetween. An elongated elastic actuator member is connected to and extends between the support member and the throwing rod at respective positions on the support member and the throwing rod spaced from the pivotal connection. A tennis ball holding member is connected adjacent a distal end of the throwing rod and opens toward the support member to receive a tennis ball placed therein. A resilient stop member is connected to the support member to make contact with the throwing rod as it accelerates toward a final position thereof by the stretched actuator member. The free length of the actuator member establishes an at-rest position of the throwing rod from which the throwing rod may be forcibly displaced by pivotal movement thereof away from said support member which elastically extends and tensions the actuator member into a ready position to hurl a tennis ball from the holding member when the throwing rod impacts against the stop member after being released from the ready position.

9 Claims, 2 Drawing Sheets

TENNIS BALL THROWING DEVICE

BACKGROUND OF THE INVENTION

1. Scope of Invention

This invention relates generally to devices for hurling or throwing an object, and more particularly to a portable tennis ball throwing device attachable to an upright post of a tennis net.

2. Prior Art

The following U.S. patents disclose a number of devices for hurling or throwing a sports-related object such as a tennis ball, baseball or football as follows:

U.S. Pat. No. 1,777,976 Lacoste

U.S. Pat. No. 3,779,227 Scott

U.S. Pat. No. 3,802,409 Mike et al.

U.S. Pat. No. 4,261,319 Dixon

U.S. Pat. No. 5,123,643 Heilhecker et al.

U.S. Pat. No. 5,383,657 Rathmell

U.S. Pat. No. 5,975,527 Winchester

The '643 patent to Heilhecker teaches an apparatus for accurately and adjustably throwing the ball to a specific location with variable speed. The Heilhecker device is attachable by ground anchors to a horizontal surface and utilizes a flexible pouch and elastic straps in somewhat slingshot fashion to propel the ball along an elevated planar deck.

Mike, in U.S. patent '409 teaches an elastic-type surface supported portable indoor/outdoor ball-projecting device which is again anchorable to a horizontal surface and utilizes a slingshot arrangement to propel the ball.

A unique "twist" is found in the elastic powered curve-ball throwing device taught by Rathmell in U.S. '657. A pouch system holds the ball as it accelerates and subsequently releases the ball when the momentum of the ball carries it out of the decelerating pouch. A strap wrapped around the ball introduces spin necessary to effect a curved ball flight.

The present invention teaches a portable tennis ball-throwing device which is attachable to an upright post of a tennis net. The simplicity of the device and the versatility associated with ball velocity and vertical and horizontal angles of tennis ball flight at departure are also features of this present invention.

BRIEF SUMMARY OF THE INVENTION

This invention is directed to a portable tennis net post-supported tennis ball throwing device including an elongated support member with a clamp arrangement for attaching the support member in an upright orientation to an upright tennis net support post. An elongated rigid throwing rod is pivotally connected at a lower end thereof to the support member by a pivotal connection therebetween. An elongated elastic actuator member, preferably formed of surgical tubing, is connected to and extends between the support member and the throwing rod at respective positions on the support member and the throwing rod spaced from the pivotal connection. A tennis ball holding member is connected adjacent a distal end of the throwing rod and opens toward the support member to receive a tennis ball placed therein. A resilient stop member is connected to the support member to make contact with the throwing rod as it accelerates toward a final position thereof by the stretched actuator member. The free length of the actuator member establishes an at-rest position of the throwing rod from which the throwing rod may be forcibly displaced by pivotal movement thereof away from said support member which elastically extends and tensions the actuator member into a ready position to hurl a tennis ball from the holding member when the throwing rod impacts against the stop member after being released from the ready position.

It is therefore an object of this invention to provide a portable tennis ball throwing device which is economical to manufacture and easy to deploy by attachment to an upright tennis net post.

It is yet another object of this invention to provide a portable tennis ball throwing device utilized for practice which is capable of varying the height of the arch of the tennis ball in flight, as well as the horizontal angle of flight of the tennis ball with respect to the tennis net post.

In accordance with these and other objects which will become apparent hereinafter, the instant invention will now be described with reference to the accompanying drawings.

DETAILED DESCRIPTION OF THE INVENTION

Figure 1:
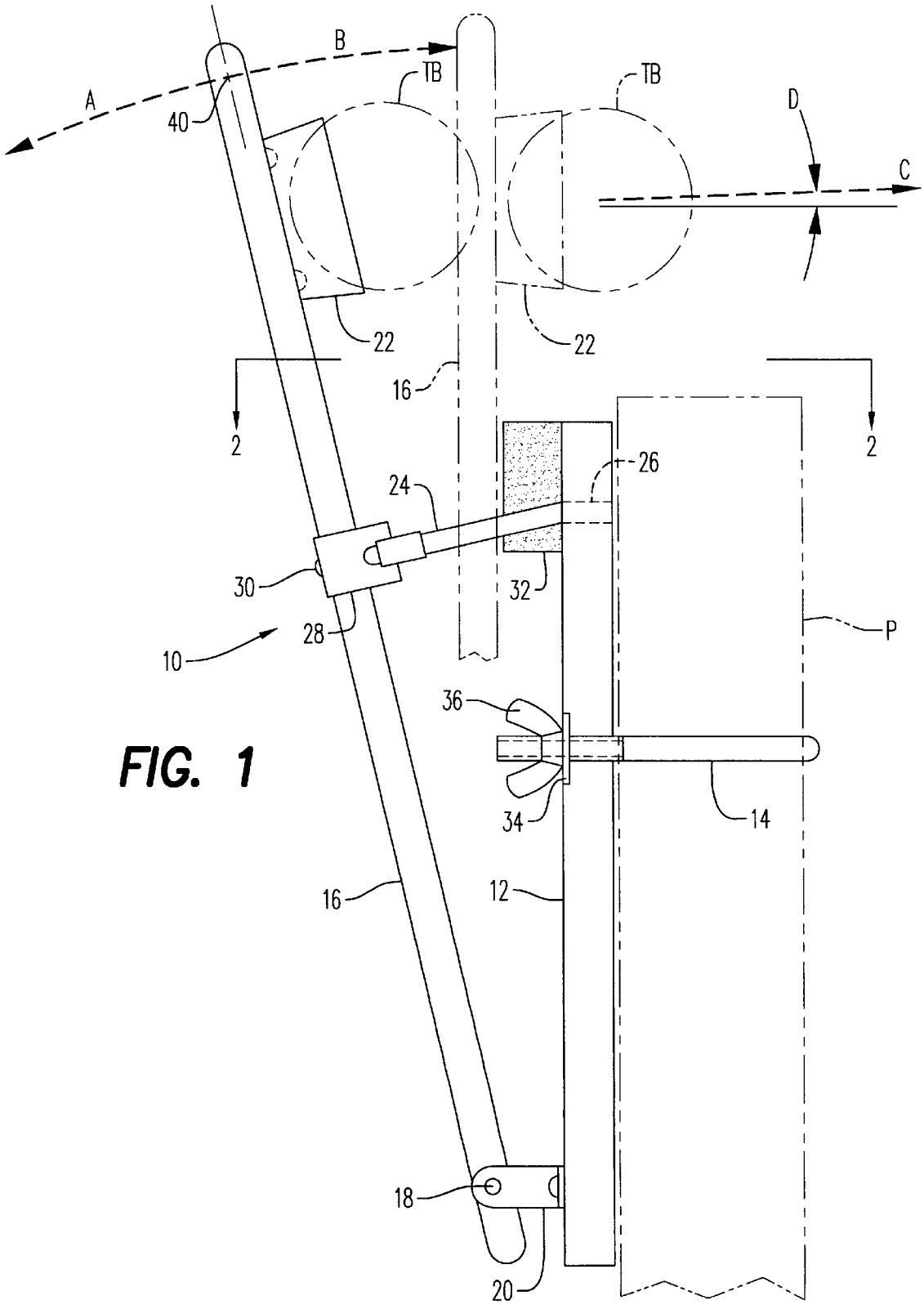
FIG. 1 is a side elevation view of the invention attached to a tennis net post in phantom an depicting the at-rest position shown in solid and the final position of the device as a tennis ball is launched therefrom.
Figure 2:
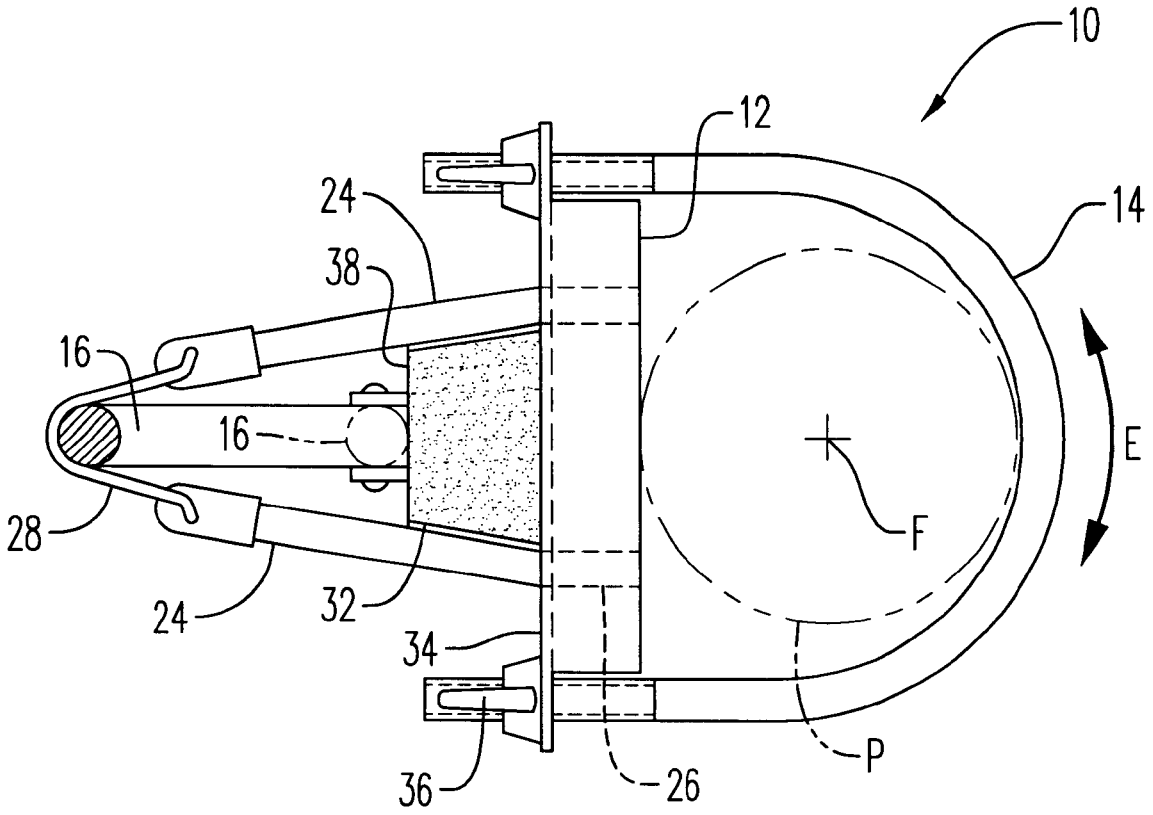
FIG. 2 is a section view in the direction of arrows 2—2 in FIG. 1.

Referring now to the drawings, the invention is shown in FIGS. 1 and 2 generally at numeral 10. This tennis ball throwing device 10 is highly portable and compact in overall physical size and use and includes an elongated support member 12 formed preferably of a length of stock wood material, a U-shaped metal clamp 14, an elongated throwing rod 16 and a tennis ball holding member 22.

The support member 12 is conveniently clampable by the U-shaped clamp 14 to an upright tennis net post shown in phantom at P. After the clamp 14 is fitted around the post P, threaded wing nuts 36 acting against a metal support plate 34 secure the support member 12 against the normally cylindrical post P.

The elongated throwing rod 16 is pivotally connected at its lower end at pivotal connection 18 to bracket 20 which is attached to the lower end of support member 12. A tennis ball holding member 22 is connected adjacent the distal end of the throwing rod 16. This tennis ball holding member 22 is in the form of a thin-walled plastic resilient cup which receives preferably less than half of the diameter of a typical tennis ball shown in phantom at TB to provide sufficient supportive engagement to maintain constant contact therebetween until the tennis ball TB and the throwing rod 16 reach their terminal or final position shown in phantom at 16.

The device 10 also includes an elongated elastic actuator member in the form of two spaced apart lengths of surgical tubing 24, each of which is embedded at 26 and secured into the support member 12 adjacent its upper end. The opposite ends of each of the elastic members 24 are connected to the central portion of the throwing rod 16 by a length of flexible leather 28 attached by fastener 30 to the throwing rod 16 as shown.

A resilient foam stop member 32 is attached between the elastic members 24 adjacent the upper end of the support member 12. The thickness of the stop member 32 determines the final angular orientation of the throwing rod 16 just prior to the launching of the tennis ball TB as shown in phantom in the direction of arrow C.

In use, after attachment of the support member 12 to the post P, a tennis ball TB is placed into the holding member 22 and the distal end of the throwing rod 16 is grasped and pivotally drawn in the direction of arrow A to elastically extend the elastic actuator members 24. The degree of elastic extension of these elastic members 24 will determine the velocity of the tennis ball TB as it is launched or hurled free of the holding member 22 in the direction of arrow C.

When the throwing rod 16 is released, it is rapidly accelerated through the neutral position at 40 determined by the relaxed length of the elastic members 24 in the direction of arrow B. The throwing rod 16 is abruptly stopped by the stop member 32 in a generally upright orientation at which point the tennis ball TB is launched free of the holding member 22 in the direction of arrow C.

By selection or variation of the overall thickness of the holding member 22, the range angle D above horizontal is determined so that variations in the arc of the tennis ball TB in flight may be effected. Likewise, by rotation of the device 10 about the upright axis F of post P as shown in FIG. 2, the horizontal or lateral direction of tennis ball flight may be easily effected just prior to release of the throwing rod.

As should be recognized at this point, the device 10 is easily deployed by attachment of a single clamp 14 around the tennis net post P, rendering the device 10 ready for use. By simply placing a tennis ball TB into the holding member 22 and elastically extending the elastic members 24 by pivotally urging the throwing rod 16 in the direction of arrow A and, thereafter, releasing the throwing rod 16, quick and repeated tennis ball launchings may be effected with variations of horizontal angle effected by movement of the entire apparatus in the direction of arrow E shown in FIG. 2.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable tennis net post-supported tennis ball-throwing device comprising:

an elongated support member including a clamp means for attaching said support member in an upright position of said support member to an upright tennis net support post;

an elongated rigid throwing rod pivotally connected at one end portion thereof to said support member by a pivotal connection therebetween;

an elongated elastic actuator member connected to and extending between said support member and said throwing rod at positions on said support member and said throwing rod spaced from said pivotal connection;

a tennis ball holding member connected adjacent a distal end of said throwing rod and opening toward said support member to receive a tennis ball placed therein;

a resilient stop member connected to, and positioned on, said support member to make contact with said throwing rod in a final position thereof;

a free length of said actuator member establishing an at-rest position of said throwing rod from which said throwing rod may be forcibly urged by pivotal movement of said throwing rod away from said support member to elastically extend and tension said actuator member into a ready position to hurl a tennis ball from said holding member when said throwing rod impacts against said stop member after being released from the ready position.

2. A portable tennis net post-supported tennis ball-throwing device as set forth in claim 1, wherein:

said stop member is sized in thickness to control an elevation angle at which the tennis ball is hurled with respect to the horizontal surface of a tennis court.

3. A portable tennis net post-supported tennis ball-throwing device as set forth in claim 2, wherein:

said support member is selectively rotationally positionable about an upright axis of the support post so as to selectively vary the radial direction from the post that the tennis ball is hurled.

4. A portable tennis net post-supported tennis ball-throwing device as set forth in claim 1, wherein:

said ball holder is in the form of a cup into which the tennis ball is positionable for hurling.

5. A portable tennis net post-supported tennis ball-throwing device comprising:

an elongated support member including a mechanical clamp for attaching said support member in an upright position of said support member to an upright tennis net support post;

an elongated rigid throwing rod pivotally connected at a lower end thereof to said support member by a pivotal connection therebetween;

a pair of elongated elastic actuator members each connected to and extending between said support member and said throwing rod at positions on said support member and said throwing rod spaced from said pivotal connection;

a tennis ball holding cup connected adjacent a distal end of said throwing rod and opening toward said support member to receive a tennis ball placed therein;

a resilient stop member connected to said support member in proximity to said actuator member to make contact with said throwing rod to define a final position thereof;

a free length of said actuator members establishing an at-rest position of said throwing rod from which said throwing rod may be forcibly urged by pivotal movement of said throwing rod away from said support member to elastically extend and tension said actuator members into a ready position to hurl a tennis ball from said holding member when said throwing rod impacts against said stop member after being released from the ready position.

6. A portable tennis net post-supported tennis ball-throwing device as set forth in claim 5, wherein:

said stop member is sized in thickness to control an elevation angle at which the tennis ball is hurled with respect to the horizontal surface of a tennis court.

7. A portable tennis net post-supported tennis ball-throwing device as set forth in claim 6, wherein:

said support member is positionable about an upright axis of the support post so as to selectively vary the direction that the tennis ball is hurled.

8. A portable tennis net post-supported tennis ball-throwing device as set forth in claim 1, wherein:

said ball holder is in the form of a cup into which the tennis ball is positionable for hurling.

9. A portable tennis net post-supported tennis ball-throwing device comprising:

an elongated flat support member including a U-shaped clamp for temporary attachment of said support member in an upright position of said support member to an upright tennis net support post;

an elongated throwing rod pivotally connected at a lower end thereof to a lower end of said support member by a pivotal connection therebetween;

an elongated elastic actuator member connected to and extending between said support member and said throwing rod at positions on said support member and said throwing rod spaced from said pivotal connection, said actuator member formed of two spaced apart equal lengths of surgical tubing;

a tennis ball holding member formed as a resilient cup connected adjacent a distal end of said throwing rod and opening toward said support member, said holding member sized to receive a portion of a tennis ball placed therein less than half the diameter of the tennis ball;

a resilient stop member connected to, and positioned on, said support member to make contact with, and to arrest forward pivotal movement of, said throwing rod as it is moved into a final position thereof;

a free length of said actuator member establishing an at-rest position of said throwing rod from which said throwing rod may be forcibly urged by pivotal movement of said throwing rod away from said support member to elastically stretch and tension said actuator member into a ready position to hurl a tennis ball from said holding member when said throwing rod impacts against said stop member after being released from the ready position.

* * * * *